United States Patent [19]

Robertson

[11] 4,007,696

[45] Feb. 15, 1977

[54] SOLID FUEL CONVERSION FURNACE

[76] Inventor: Richard L. Robertson, Rte. 1 Box 486c, Port Orchard, Wash. 98366

[22] Filed: Oct. 1, 1975

[21] Appl. No.: 619,141

[52] U.S. Cl. ..... 110/31; 110/24; 110/29; 110/84

[51] Int. Cl.[2] ..... C10B 57/00; F23B 1/36

[58] Field of Search ..... 110/11, 24, 25, 29, 110/31, 84; 122/5

[56] References Cited

UNITED STATES PATENTS

| | | | |
|---|---|---|---|
| 779,467 | 1/1905 | Cravath | 110/29 |
| 2,160,481 | 5/1939 | Lockwood | 110/84 |
| 2,284,506 | 5/1942 | Zuberbuhler | 110/29 |
| 2,592,730 | 4/1952 | Perkins | 110/31 |
| 3,777,676 | 12/1973 | Lagen | 110/11 |

*Primary Examiner*—Kenneth W. Sprague
*Attorney, Agent, or Firm*—R. S. Sciascia; Charles D. B. Curry

[57] ABSTRACT

A solid fuel conversion furnace for breaking down solid fuel into its two basic combustible components, combustible gases and combustible solids, prior to ignition. This is achieved by preheating the solid fuel when it is not in the presence of a combustion supporting atmosphere. This preheating of the solid fuel is achieved through the use of a heat exchange compartment where the hot exhaust gases transfer their heat through the heat exchange wall to preheat the solid fuel in the fuel compartment. The hot exhaust gases are obtained from the ignition of the combustible gases and the combustible solids in the presence of oxygen. This ignition occurs in the fire box area which is below the fuel compartment. The combustible solids are gravity fed to the fire box and the combustible gases are fed to the fire box by both their self-generated pressure and the furnace exhaust draft.

6 Claims, 10 Drawing Figures

SOLID FUEL CONVERSION FURNACE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The present invention relates to a furnace and more particularly to a solid fuel conversion furnace.

2. Description of the Prior Art

There have been many attempts to develop furnaces which effectively burn all types of fuel such as wood, coal, leaves, sawdust, vegetables and all form of organic matter. One of the difficulties has been the inability of these furnaces to properly extract or separate the combustible solids and combustible gases in a manner where they may be completely and effectively burned.

The present invention overcomes this disadvantage by employing a furnace that first converts solid fuel into its two basic components, combustible gases and combustible solids, and then ignites these components to thereby completely and effectively burn the solid fuel.

SUMMARY OF THE INVENTION

Briefly, the present invention relates to a solid fuel conversion furnace for breaking down solid fuel into its two basic combustible components, combustible gases and combustible solids, prior to ignition. This is achieved by preheating the solid fuel when it is not in the presence of a combustion supporting atmosphere. This preheating of the solid fuel is achieved through the use of a heat exchange compartment where the hot exhaust gases transfer their heat through the heat exchange wall to preheat the solid fuel in the fuel compartment. The hot exhaust gases are obtained from the ignition of the combustible gases and the combustible solids in the presence of oxygen. This ignition occurs in the fire box area which is below the fuel compartment. The combustible solids are gravity fed to the fire box and the combustible gases are fed to the fire box by both their self-generated pressure and the furnace exhaust draft.

OBJECTS OF THE INVENTION

An object of the present invention is to provide a furnace that is inexpensive, effective and efficient.

Another object of the present invention is to provide a furnace that converts solid fuel into its two basic components, combustible gases and combustible solids, prior to ignition.

Still another object of the present invention is to provide a solid fuel conversion furnace where the fuel may be any form of combustible matter such as wood, coal, leaves, sawdust, vegetables and all forms of organic matter.

A further object of the present invention is to convert solid fuel into its combustible gas and combustible solid components by heating the fuel in the absence of air by heat exchange relationship with the hot exhaust gases of the furnaces.

Other objects, advantages and novel features of the invention will become apparent from the following detailed description of the invention when considered in conjunction with the accompanying drawings wherein:

DESCRIPTION OF THE PREFERRED EMBODIMENT

Figure 1:
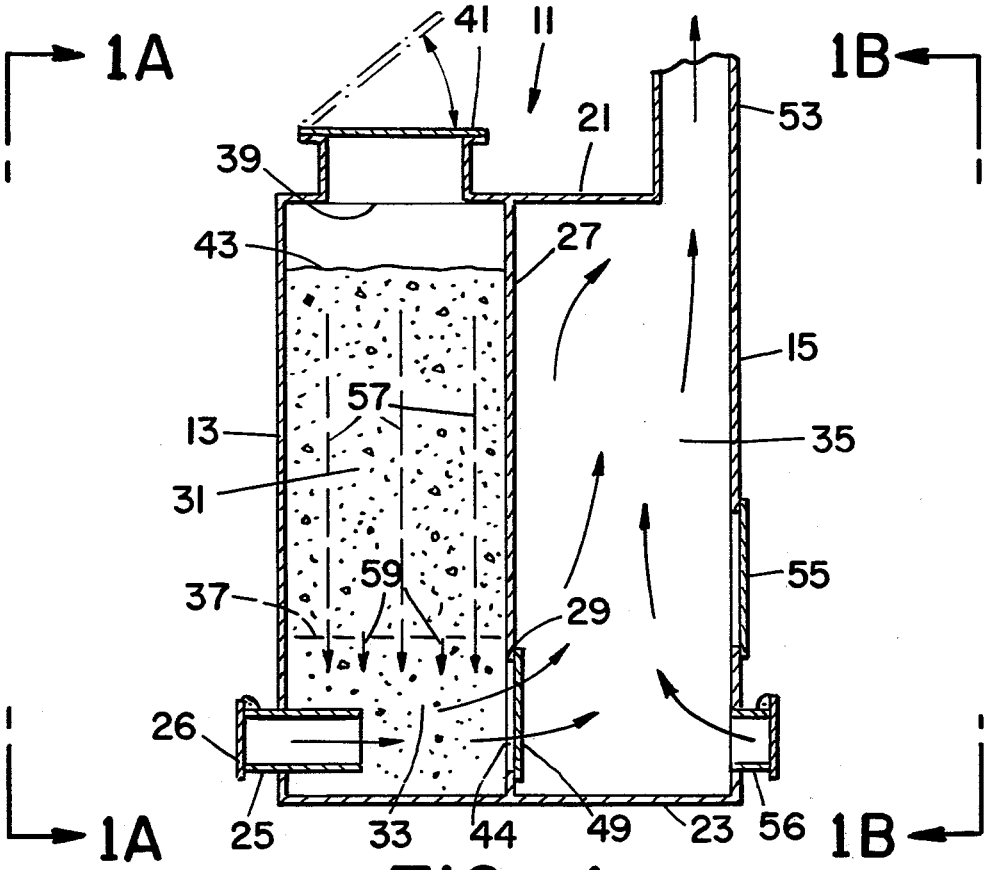
FIG. 1 is a side elevation of one embodiment of the solid fuel conversion furnace of the present invention.

The basic concept of the furnace of the present invention is to break down the fuel into its two basic combustible components, combustible gases and combustible solids, prior to ignition. This is achieved by preheating the fuel when it is not in the presence of a combustion supporting atmosphere. This preheating of the fuel is achieved through a heat exchanger where the hot exhaust gases transfer their heat through the heat exchanger to preheat the fuel in the fuel compartment. The hot exhaust gases are obtained from the ignition of the combustible gases and the combustible solids in the presence of oxygen. This occurs in the fire box area which is preferably located below the fuel compartment so that the solid combustibles may be gravity fed to the fire box.

One of the major advantages of the furnace of the present invention is that it has been found to be particularly effective for burning all types of solid combustible fuels. These solid combustible fuels may include, but are not limited to, coal, wood, leaves, sawdust, plastics, paper, all forms of waste garbage such as vegetables, meat, fat, bones, any organic material, and even certain metals may serve as a fuel. As will be hereinafter apparent, the furnace may also burn combustible gases or liquids but that is not its primary purpose. It is intended that liquids and gases are to be used as a fuel only when they were mixed with the solid fuels such as may be the case in certain types of solid waste such as rags containing oil or the like.

It should be noted that each type of fuel will be broken down into different gases and solids during the preheating process. No attempt will be made to define all of the complex combustible and non-combustible gases that are generated by preheating the fuels and no attempt will be made to define all of the complex combustible and non-combustible solids that are generated by the preheating of the fuels. However, it should be noted that typical combustible gases that may be generated are methane, ethane, ethylene, hydrogen and carbon monoxide. Typical non-combustible gases that may be generated are water vapor, carbon dioxide and sulfur dioxide. It should be also noted that typical combustible solids that may be generated are carbon, carbonaceous residue including polymer carbons, high moleculer weight hydrocarbons and polymers and polymer fragments from plastics celluloses and proteins. Typical non-combustible solids that may be generated include various metals (however, depending on the temperature of operation, certain of the metals will be burned to form their oxides), and certain salts such as phosphates, carbonates and silicates.

It should be noted that the non-combustible gases will pass out through the exhaust stack and the non-combustible solids will be collected at the bottom of the fire area, with some of the solids being carried out through the exhaust stack by the hot exhaust gases.

Several different embodiments of the present invention will be described since different embodiments will be more useful with different types of fuels. Moreover, these embodiments will illustrate different types of heat exchangers which may be required for different fuels. However, the above described basic concepts are employed in all embodiments and it will be understood that various other embodiments and modifications can be made provided they are compatible with the basic concepts and teachings of the present invention.

Figure 1A:
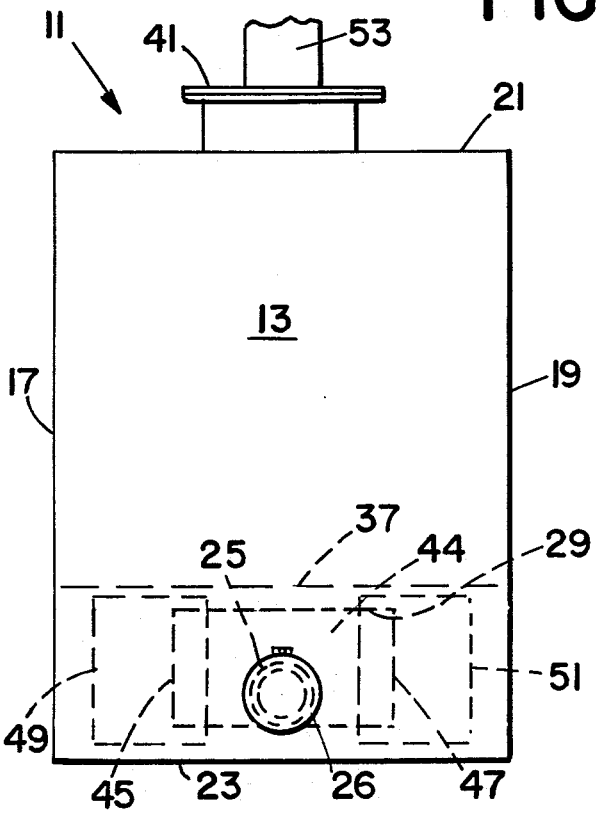
FIG. 1A is a front view of the furnace taken at section A—A of FIG. 1.
Figure 1B:
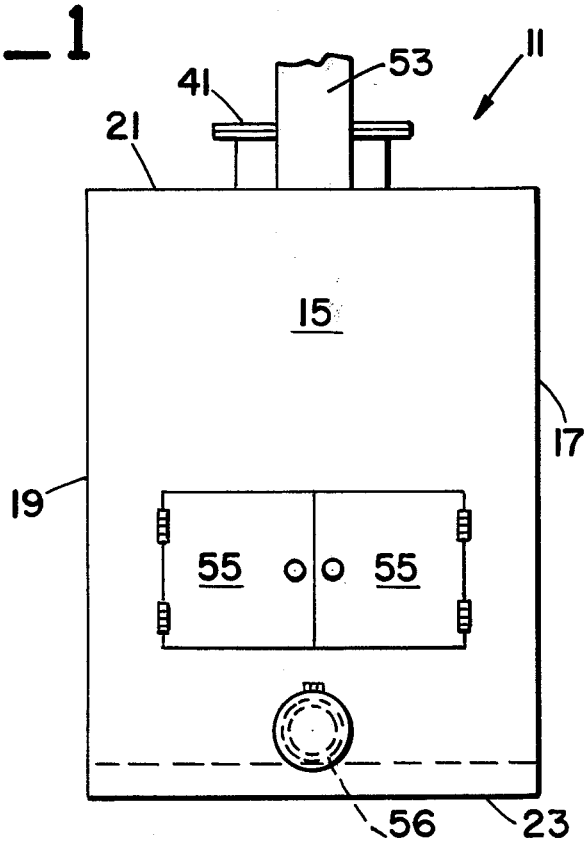
FIG. 1B is a rear view of the furnace taken at section B—B of FIG. 1.

In FIGS. 1A, 1B and 1C is illustrated one embodiment of the furnace 11 of the present invention. Referring to FIGS. 1A, 1B and 1C furnace 11 includes an exterior structure having four sides 13, 15, 17 and 19, a top 21 and a bottom 23. The furnace also includes an air inlet 25 having a control member 26 and a heat exchange wall or partition 27. Heat exchange wall 27 extends between sides 17 and 19 and from top 21 to the lower edge 29 which is spaced above bottom 23. It is critical that the periphery of heat exchange wall 27 be rigidly attached to and in sealing engagement with the adjacent surfaces of sides 17 and 19 and top 21. This basic structure defines the fuel compartment 31, the fire compartment 33, and the heat exchange compartment 35. Depending upon the type of fuel being burned, a shelf structure 37, shown in dotted lines, may be employed. The shelf structure 37 has a plurality of spaced apart openings and is preferably used when the fuel is of the shredded, chipped or pulverized type. The shelf structure may be of many types and configurations and in FIG. 1A it is illustrated as extending the width of the fuel compartment 31 and in FIG. 1 as extending between side 13 and the lower edge of heat exchange wall 27. The shelf 37 may be rigidly attached to side 13 and the lower edge of heat exchange wall 27 or it may be supported by support members, not shown.

Fuel compartment 31 is provided with a fuel inlet opening 39 that has a sealable access door 41 that may be removed when it is desired to load fuel into the fuel compartment 31. In FIG. 1 the fuel compartment is shown as containing fuel the upper level of which is indicated by reference numeral 43. Fuel compartment 31 also includes an exhaust outlet opening 44 the width of which is indicated by dotted lines 45 and 47 where its degree of opening is controlled by movable shutters 49 and 51. The heat exchange compartment 35 includes an exhaust stack of flue 53, access doors 55 and an opening 56 that may be used for an induced draft.

In operation, fuel is added to fuel compartment 31, air is supplied through air opening 25, fire compartment exhaust opening 44 is opened (shutters 49 and 51 being in the position shown in FIG. 1A), fuel supply door 41 is shut and sealed and a fire is started in fire compartment 33. The initial fire may be a conventional starter fire. As the exhaust from the fire passes into heat exchange compartment 35 it heats heat exchange wall 27. This heats the fuel in fuel compartment 31, which contains no oxygen, and causes the fuel to break down into combustible gases and combustible solids. The combustible gases are drawn downward, due to their self-generated pressure and the fire draft, as illustrated by dotted line arrows 57. The solid fuel moves downward, through the openings in shelf 37, by gravity action as illustrated by solid line arrows 59. This has been found to be an extremely efficient furnace and, because of the heat exchanger heating the fuel in the absence of a combustion supporting atmosphere, it is possible to break down virtually any waste or organic material into combustible gases and combustible solids which are then simultaneously fed to the fire compartment where they are burned.

After the furnace is in operation and it is desirable to add more fuel, the air inlet draft opening 25 is closed and the exhaust openings are left wide open. The hot exhaust stack gases pull a vacuum on the heat exchange compartment 35, the fire compartment 33 and the fuel compartment 31. This permits opening of fuel loading access door 41 since it then also acts as an air draft opening without a blow back of combustible gases. Therefore, during this operation, with access door 41 open, additional fuel is added. After the fuel is added then access door 41 is closed and air inlet draft opening 25 is opened and the furnace 11 is now in its normal operating condition. During shut down the noncombustible solids that have collected at the bottom of fire compartment 33 may be removed by conventional means.

Figure 2:
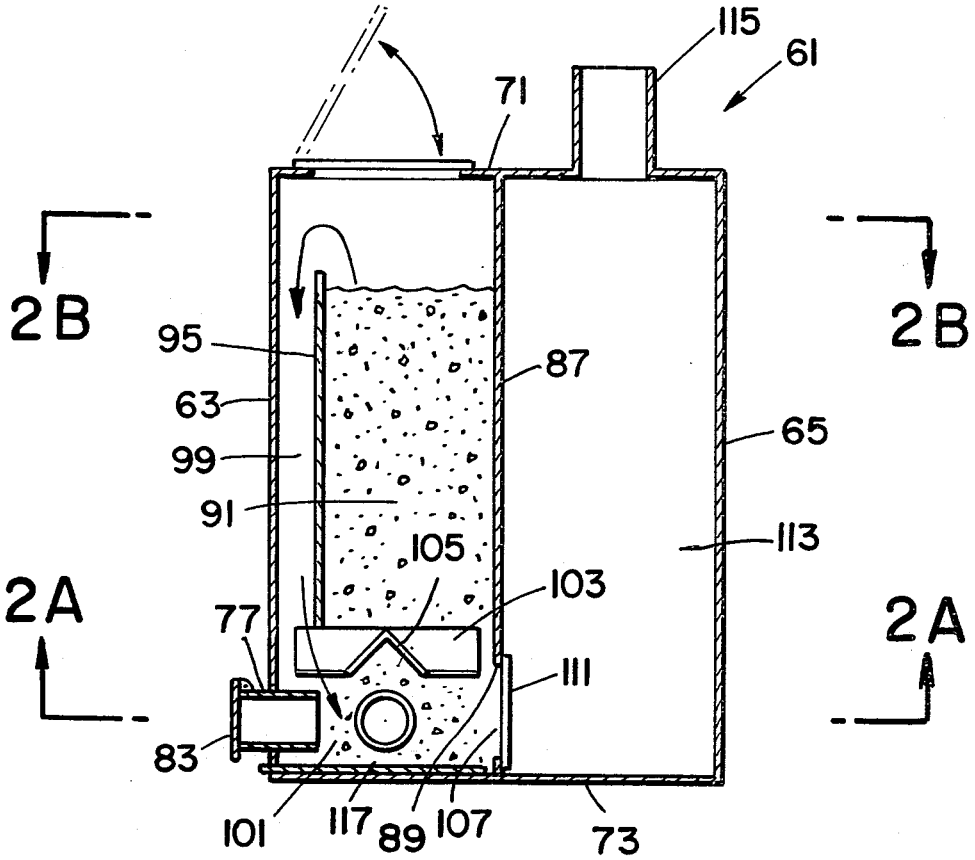
FIG. 2 is a side elevation of another embodiment of the solid fuel conversion furnace of the present invention.
Figure 2A:
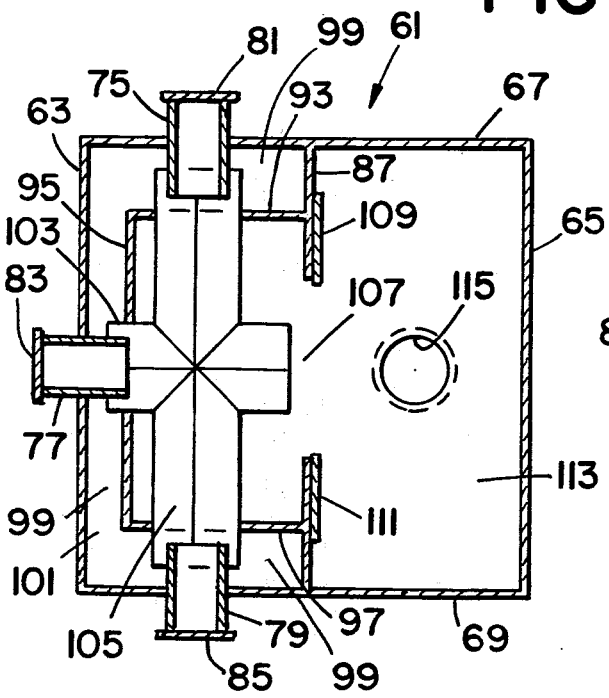
FIG. 2A is a bottom sectional view of the furnace taken at section A—A of FIG. 2.
Figure 2B:
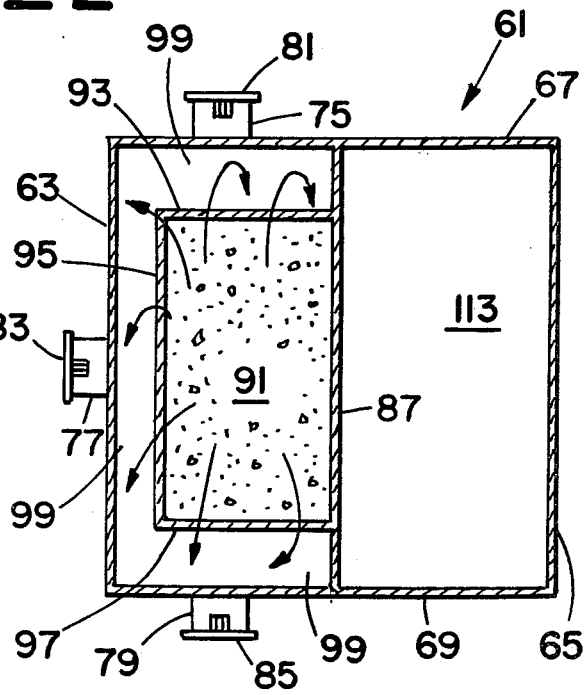
FIG. 2B is a top sectional view of the furnace taken at section B—B of FIG. 2.

In FIGS. 2, 2A and 2B is illustrated another embodiment of the present invention. Referring to FIGS. 2, 2A and 2B furnace 61 is schematically illustrated as having an exterior structure including sides 63, 65, 67 and 69, a top 71, and a bottom 73. The furnace also includes a plurality of air inlet openings 75, 77 and 79 that may be controlled by air inlet control members 81, 83 and 85. A heat exchange wall 87 extends between sides 67 and 69, and from top 71 to the lower edge 89 which is spaced above bottom 73. It is critical that the periphery of heat exchange wall 87 be rigidly attached to and in sealing engagement with the adjacent surfaces of sides 67 and 69 and top 71. The fuel compartment 91 is formed by the central section of heat exchange wall 87 and by fuel compartment walls 93, 95 and 97. These walls are solid and their edges are interconnected as shown. However, fuel compartment walls 93, 95 and 97 extend upward to a position that is spaced from top 71 and extends downward to about the same position as the lower edge 89 of heat exchange wall 87. In addition, fuel compartment walls 93, 95 and 97 have widths that provide a combustible gas outlet cavity 99 between three sides of the fuel compartment and the furnace walls as best illustrated in FIGS. 2 and 2B.

At the bottom region of fuel compartment 91 and the upper region of fire compartment 101 are positioned two triangular shaped cross members 103 and 105. These triangular shaped cross members have their apexes in the upward direction to permit the solid fuel to more readily move downward. Under the lower surface of the cross members is formed a cavity region in the surrounding solid fuel. The air is introduced by air inlets 75, 77 and 79 into this cavity. It has been found that this provides for better combustion when the fuel is of a rather fine nature.

The furnace 61 of FIGS. 2, 2A and 2B also includes an exhaust outlet opening 107, exhaust control shutters 111, heat exchange compartment 113, exhaust flue 115 and a removable tray 117 that is used to collect the non-combustible solids.

The combustible gases pass downward through the combustible gas outlet cavity 99 and mix with the combustible solids. This makes it possible for the combustible gases to have less restricted flow than in the FIG. 1 embodiment. This is more advantageous when the solid fuel is of a rather fine nature. The operation of the FIG. 2 system is similar to the FIG. 1 system and therefore will not be further described.

Figure 3A:
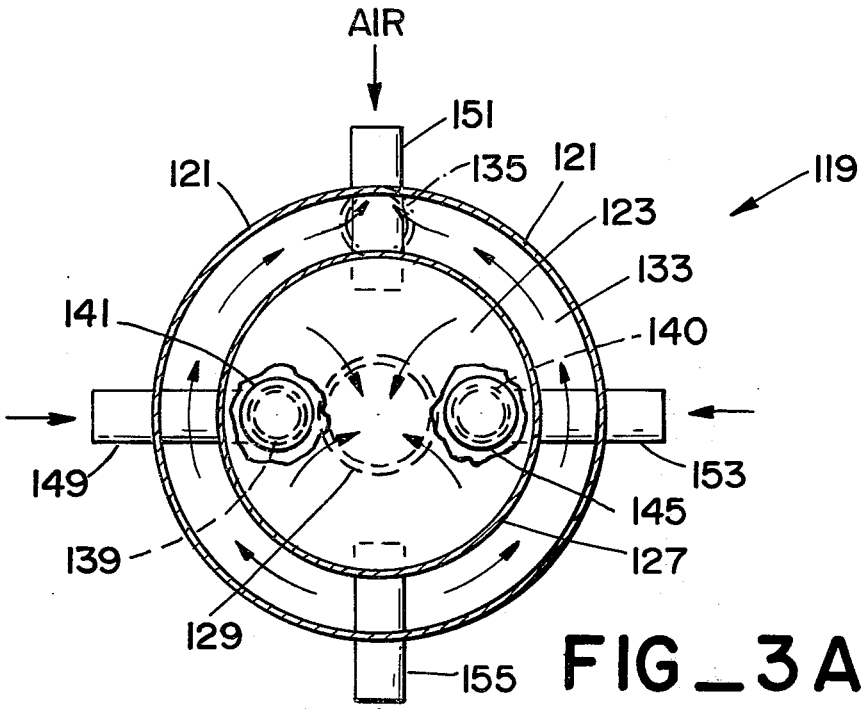
FIG. 3A is a top view of the furnace of FIG. 3 taken at section A—A of FIG. 3.
Figure 3:
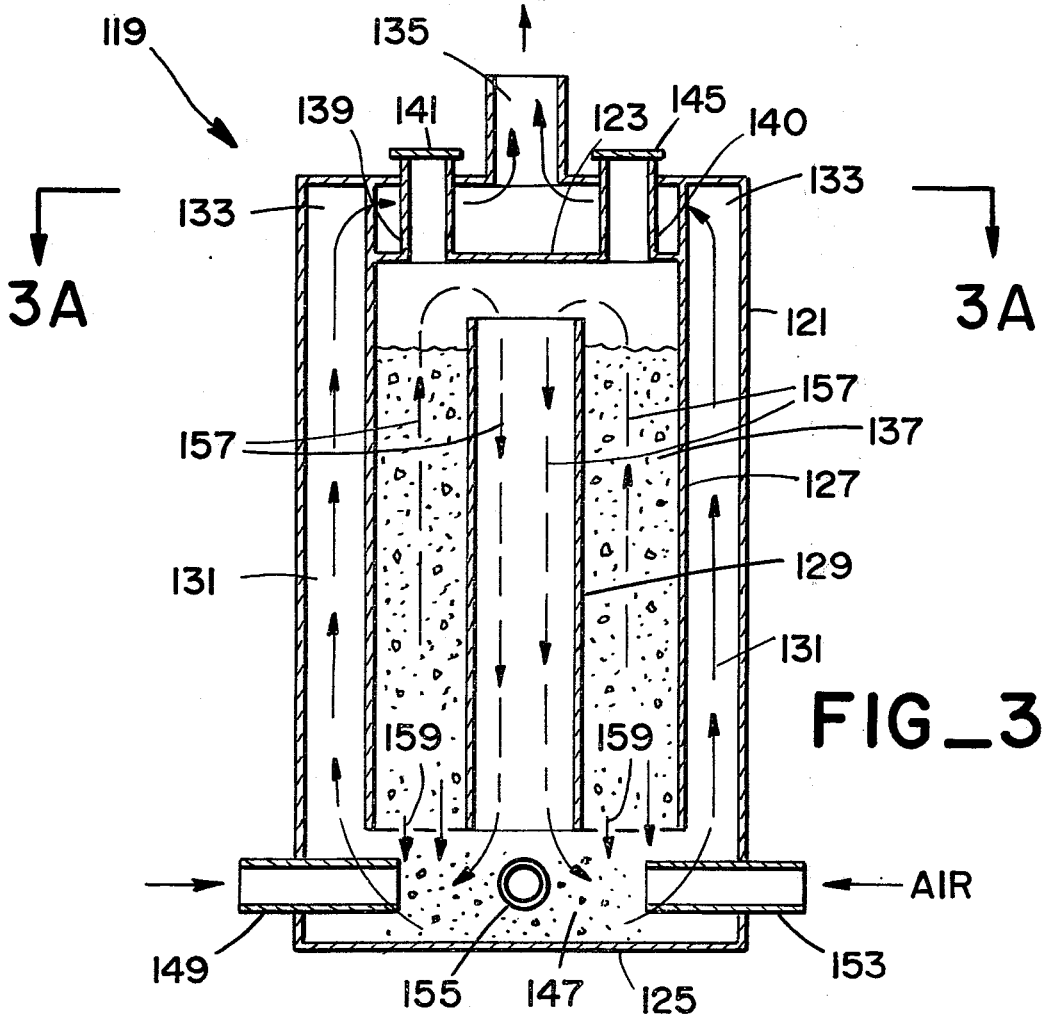
FIG. 3 is a side elevation of still another embodiment of the solid fuel conversion furnace of the present invention.

In FIG. 3 and FIG. 3A is illustrated another embodiment of the furnace 119 of the present invention. Referring to FIGS. 3 and 3A furnace 119 includes an outer cylindrical wall 121, a circular top 123, and a circular bottom 125, intermediate cylinder 127, and inner cylinder 129. An annular heat exchange compartment 131, formed between outer cylindrical wall 121 and intermediate cylinder 127, terminates in an exhaust annular ring cavity 133 at the upper end. Annular cavity 133 discharges into exhaust flue 135. An annular fuel compartment 137 is formed between intermediate cylinder 127 and inner cylinder 129. Fuel is loaded into annular fuel compartment 137 through fuel inlet openings 139 and 140 that have sealable access doors 141 and 145. Air is provided to the fire compartment 147 through air inlets 149, 151, 153 and 155 each having appropriate air control members, not shown.

In operation hot exhaust gasses pass through annular heat exchange compartment 131 where they heat the fuel in annular fuel compartment 137. The exhaust gasses then pass through annular ring cavity 133 and are then vented through exhaust flue 135. The combustible gases pass upward and then down through inner cylinder 129, as indicated by broken arrows 157, to the fire compartment 147. The combustible gases then mix with the gravity fed combustible fuel, indicated by solid arrows 159, in the fire compartment where they mix with oxygen and burn. It has been found that with certain types of fuels, such as wood or coal, that a grating is not needed under the fuel compartment since there are sufficient open passages between the pieces of fuel to permit the air and combustible gases to mix with the combustible fuel in the fuel compartment. However, as in the FIG. 1 and FIG. 2 embodiments, a grating may be provided below the annular fuel compartment 137.

The operation of the FIG. 3 system is similar to the FIG. 1 system and therefore will not be further disclosed.

Figure 4A:
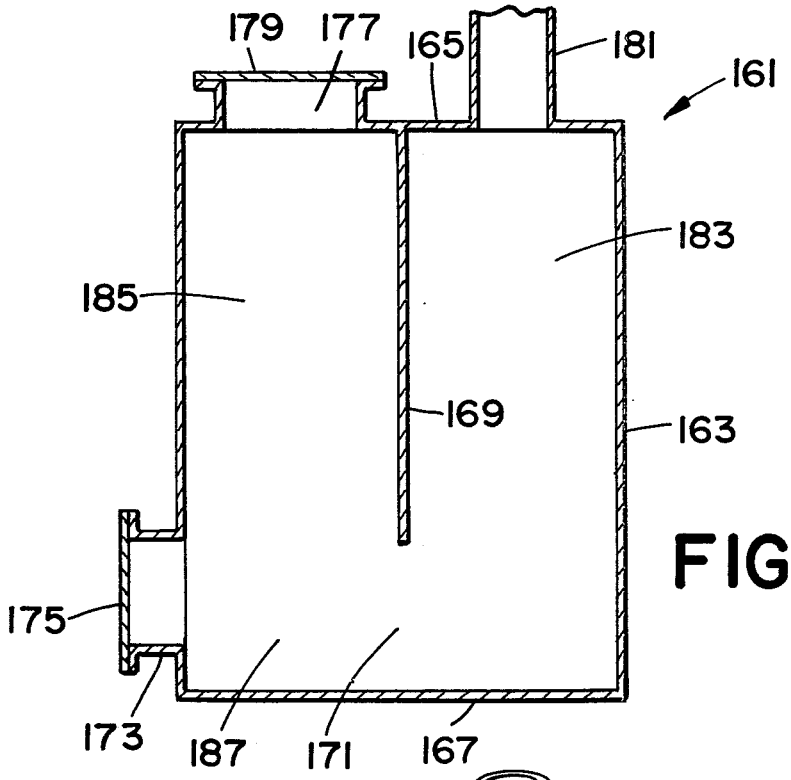
FIG. 4A is a side elevation of still another embodiment of the solid fuel conversion furnace of the present invention.
Figure 4B:
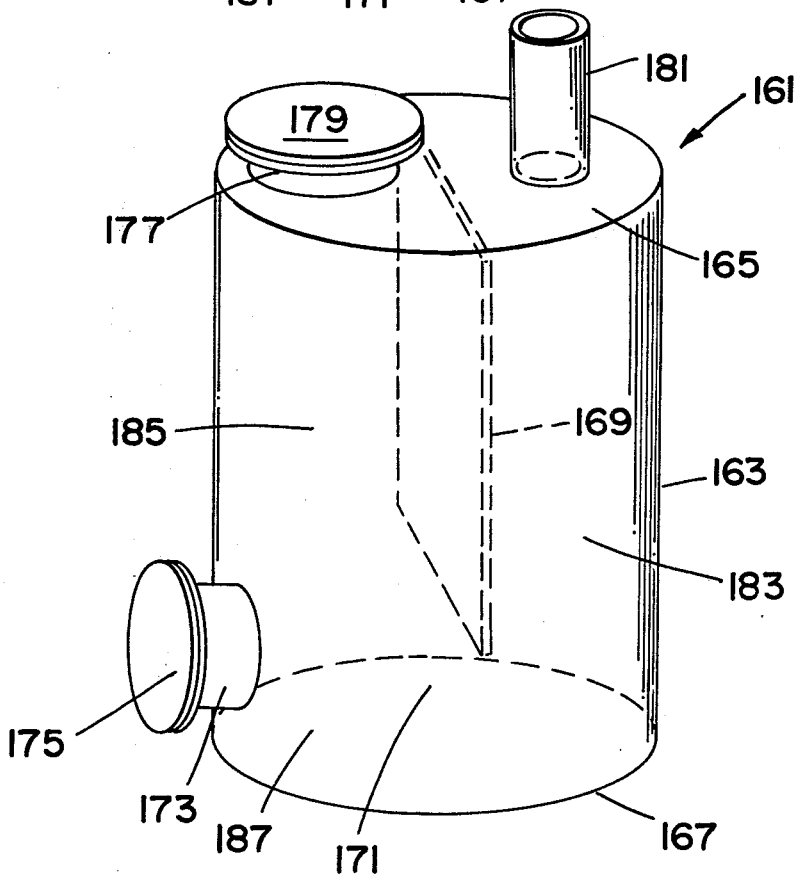
FIG. 4B is a schematic pictorial view of the solid fuel conversion furnace of FIG. 4A.

In FIGS. 4A and 4B is illustrated another embodiment of the furnace 161 of the present invention. In this embodiment the furnace 161 is relatively simple but has been found to be very effective as a small and inexpensive furnace that may be used as a home heater or incinerator. In this embodiment furnace 161 includes an outer cylindrical wall 163, circular top 165, circular bottom 167, and heat exchange wall 169. The upper edge and side edges of heat exchange wall 169 are connected in sealing engagement to the top 165 and cylindrical wall 163. The lower edge of heat exchange wall 169 terminates above bottom 167 and forms an exhaust outlet opening 171. An air inlet 173, having a control member 175, and a fuel opening 177, having a sealable access cover 179, are provided. The furnace also has an exhaust vent 181. In this manner a simple and inexpensive, but very effective furnace is provided that has a heat exchange compartment 183, a fuel compartment 185, and a fire compartment 187.

The operation of the FIG. 4 embodiment is similar to the FIG. 1 embodiment and therefore will not be further described.

What is claimed is:

1. A furnace comprising:

a. a sealable fuel compartment;

b. a fire compartment;

c. a heat exchange compartment;

d. means for loading fuel into said sealable fuel compartment wherein said fuel is exposed to a non-combustion supporting atmosphere;

e. said heat exchange compartment being in heat exchange relationship with said fuel compartment;

f. said fire compartment being positioned under said fuel compartment;

g. said fire compartment including an air inlet and an exhaust outlet;

h. said exhaust outlet communicating with said heat exchange compartment;

i. said heat exchange compartment having an exhaust gas flue;

j. said means for loading fuel is sealably connected to said fuel compartment and prevents air from entering said fuel compartment;

k. heat from said heat exchanger causes solid fuel in said fuel compartment to convert into combustible gases and combustible solids whereby;

l. said combustible solids are transmitted to said fire compartment by gravity action and said combustible gases are transmitted to said fire compartment by self-generated pressure.

2. The furnace of claim 1 wherein:

a. said furnace includes an exterior member, a top, a bottom and a heat exchange wall; and b. the upper end of said heat exchange wall being connected in sealing relationship to said top and the lower end being spaced from said bottom thereby forming an exhaust opening; whereby c. said exhaust opening communicates said fire compartment with said heat exchange compartment.

3. The furnace of claim 2 wherein:

a. said heat exchange wall has first and second edges;

b. said first and second edges being connected in sealing relationship with and on opposite positions of said exterior member; and c. said heat exchange compartment is formed between one part of said top, one part of said bottom and one part of said exterior member and one side of said heat exchange wall.

4. The furnace of claim 3 wherein:

a. said fuel compartment is formed between another part of said top, another part of said exterior member and the other side of said heat exchange wall.

5. The furnace of claim 4 wherein:

a. said fuel compartment includes an interior section;

b. said interior section having two vertically extending edges, a top edge and a bottom edge;

c. said two vertically extending edges being connected to the other side of said heat exchange wall and said top edge being spaced from said top and said bottom edge being spaced from said bottom; whereby d. a combustible gas outlet cavity is formed between the exterior surface of said interior section and said another part of said exterior surface and communicates between the upper region of said fuel compartment and said fire compartment.

6. The device of claim 1 wherein:

a. said furnace includes an exterior cylinder, a circular top, a circular bottom, an intermediate cylinder and an inner cylinder; and b. said exterior, intermediate and interior cylinders being concentric and forming a fuel compartment between said interior and intermediate cylinders and a combustible gas outlet cavity between said intermediate and outer cylinders.

* * * * *